US005526713A

United States Patent [19]

Walter

[11] Patent Number: 5,526,713

[45] Date of Patent: Jun. 18, 1996

[54] AXIALLY PIVOTABLE CRANK HANDLE FOR ADJUSTING DOLLY STAND POSTS ON TRACTOR TRAILERS

[76] Inventor: Edwin E. Walter, 1040 Dianewood Dr., Mansfield, Ohio 44903

[21] Appl. No.: 348,328

[22] Filed: Dec. 2, 1994

[51] Int. Cl.[6] ..... G05G 1/08

[52] U.S. Cl. ..... 74/545; 403/84; 403/103

[58] Field of Search ..... 74/545; 403/83, 403/84, 87, 97, 99, 103, 104, 106, 110, 111, 162; 123/185.12, 185.13; 254/DIG. 3; 81/35, 36, 37, 73, 177.6

[56] References Cited

U.S. PATENT DOCUMENTS

| | | | |
|---|---|---|---|
| 1,029,290 | 6/1912 | Henken | 123/185.13 |
| 1,037,663 | 9/1912 | Roberts et al. | 123/185.13 |
| 1,186,670 | 6/1916 | Lovering | 81/35 |
| 3,482,853 | 12/1969 | Raidel | 280/124 |
| 3,865,405 | 2/1975 | Mitchell et al. | 280/476 R |
| 3,902,733 | 9/1975 | David | 280/47.18 |
| 3,995,876 | 12/1976 | Ronne | 280/423 A |
| 4,871,183 | 10/1989 | Moss | 280/475 |
| 5,088,881 | 2/1992 | Ball et al. | 403/162 |
| 5,139,102 | 8/1992 | Pocapalia | 180/19.2 |
| 5,230,599 | 7/1993 | Orr | 414/607 |

*Primary Examiner*—Rodney H. Bonck
*Assistant Examiner*—Chong H. Kim
*Attorney, Agent, or Firm*—John D. Gugliotta

[57] ABSTRACT

The present invention provides an improved axially pivotable dolly crank handle for adjusting a conventional dolly stand post on a conventional tractor trailer, particularly when the tractor trailer is parked in very close proximity to another tractor trailer or other obstruction which restricts rotational movement of a conventional dolly crank handle. The present invention has spring-tensioned cooperating male and female members which interlock together in a plurality of orientations about an axial core. Aligning and engaging the male member with the female member locks the present invention in one of the plurality of orientations, and the spring retains the present invention in this locked position. The present invention is then used to rotate the conventional dolly stand post on the conventional tractor tailor in a manner well-known in the art. Lubrication is introduced to the axial core and to the male and female members through a grease jerk and drain holes in a protective casing, and accumulated liquid within the protective casing is drained through a drain hole in the protective casing.

6 Claims, 7 Drawing Sheets

AXIALLY PIVOTABLE CRANK HANDLE FOR ADJUSTING DOLLY STAND POSTS ON TRACTOR TRAILERS

BACKGROUND OF THE INVENTION

1. Field of the Invention

The present invention relates generally to a crank handle for adjusting dolly stand posts on tractor trailers and, more particularly, to an improved crank handle which is axially pivotable, thereby to be adjustable to a plurality of orientations.

2. Description of the Related Art

As is well-known in the art, tractor trailers are often parked in very close proximity to each other in order to exploit available space. This close proximity often limits access to a trailer dolly beneath each trailer, sometimes requiring an operator to crawl beneath a first trailer to reach the dolly of a second trailer. Further, rotational use of a conventional dolly crank which is not axially pivotable and which extends outwardly away from a side of the trailer may be restricted by the second trailer parked alongside. As a result, the conventional dolly crank handle which is obstructed by a nearby second trailer cannot be used to raise the dolly stand posts, thereby requiring the operator to pull the trailer from a parked position with the dolly stand posts in a down position, sometimes resulting in significant damage to the dolly stand posts.

Another problem occurs from water that often collects in conventional dolly cranks which are fabricated as a single unit. Typically, water that collects in the conventional dolly crank while the crank is anchored to the dolly stand splashes the operator when the dolly crank is being removed from the dolly stand.

Furthermore, a metal sleeve on a handle of a conventional dolly crank typically rusts over time. The rust causes the metal sleeve to separate from the handle and to become brittle and jagged, thereby cutting the operator's hands when rotating the dolly crank handle.

Consequently, a need has been felt for providing a dolly crank handle for a tractor trailer dolly stand which overcomes the restricted movement problems associated with tractor trailers which are parked in close proximity to each other, and which overcomes the problems associated with rust and splashing the operator with collected water.

SUMMARY OF THE INVENTION

It is therefore an object of the present invention to provide an improved axially pivotable dolly crank handle having spring-tensioned cooperating male and female members which lock in a plurality of orientations about an axial core.

It is a feature of the present invention to provide a crank handle constructed of a durable metal material, such as steel, for instance.

It is a further feature of the present invention to provide a drain hole at a first angled bend thereof.

It is a further feature of the present invention to provide a grease zerk for lubrication of internal members thereof.

Briefly described according to one embodiment of the present invention, an improved axially pivotable dolly crank handle is provided for adjusting a conventional dolly stand post on a conventional tractor trailer, particularly when the tractor trailer is parked in very close proximity to another tractor trailer or other obstruction which restricts rotational movement of a conventional dolly crank handle. The present invention has spring-tensioned cooperating male and female members which interlock together in a plurality of orientations about an axial core. Aligning and engaging the male member with the female member locks the present invention in one of the plurality of orientations, and the spring retains the present invention in this locked position. The present invention is then used to rotate the conventional dolly stand post on the conventional tractor trailer in a manner well-known in the art. Lubrication is introduced to the axial core and to the male and female members through a grease zerk and drain holes in a protective casing, and accumulated liquid within the protective casing is drained through a drain hole in the protective casing.

In accordance with a preferred embodiment, a crank handle is provided for adjusting a rotational crank of a dolly stand post on a tractor trailer, wherein the crank handle comprises: a first cylindrical member having a male prong protruding from a first cylindrical member end; a second cylindrical member having a second cylindrical member end which defines a plurality of female grooves for receiving and cooperating with the male prong; a spring; and an axle axially disposed within the first cylindrical member, the second cylindrical member, and the spring, such that the spring urges the first cylindrical member toward the second cylindrical member thereby to engage into a locked position the male prong with one of the plurality of female grooves by rotating the first cylindrical member about the axle relative to the second cylindrical member.

An advantage of the present invention is that it is adjustable to a plurality of orientations to exchange leverage for unobstructed positioning, as required according to the proximity of an obstruction to the present invention.

Another advantage of the present invention is that it is universally adaptable to be attached to most conventional dolly cranks.

Another advantage of the present invention is that damage to expensive trailer equipment is minimized.

Another advantage of the present invention is that crawling underneath trailers parked in very close proximity to each other is minimized.

Another advantage of the present invention is that it minimizes accumulated water which otherwise splashes drivers.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1Detailed description of the Figures

Figure 1:
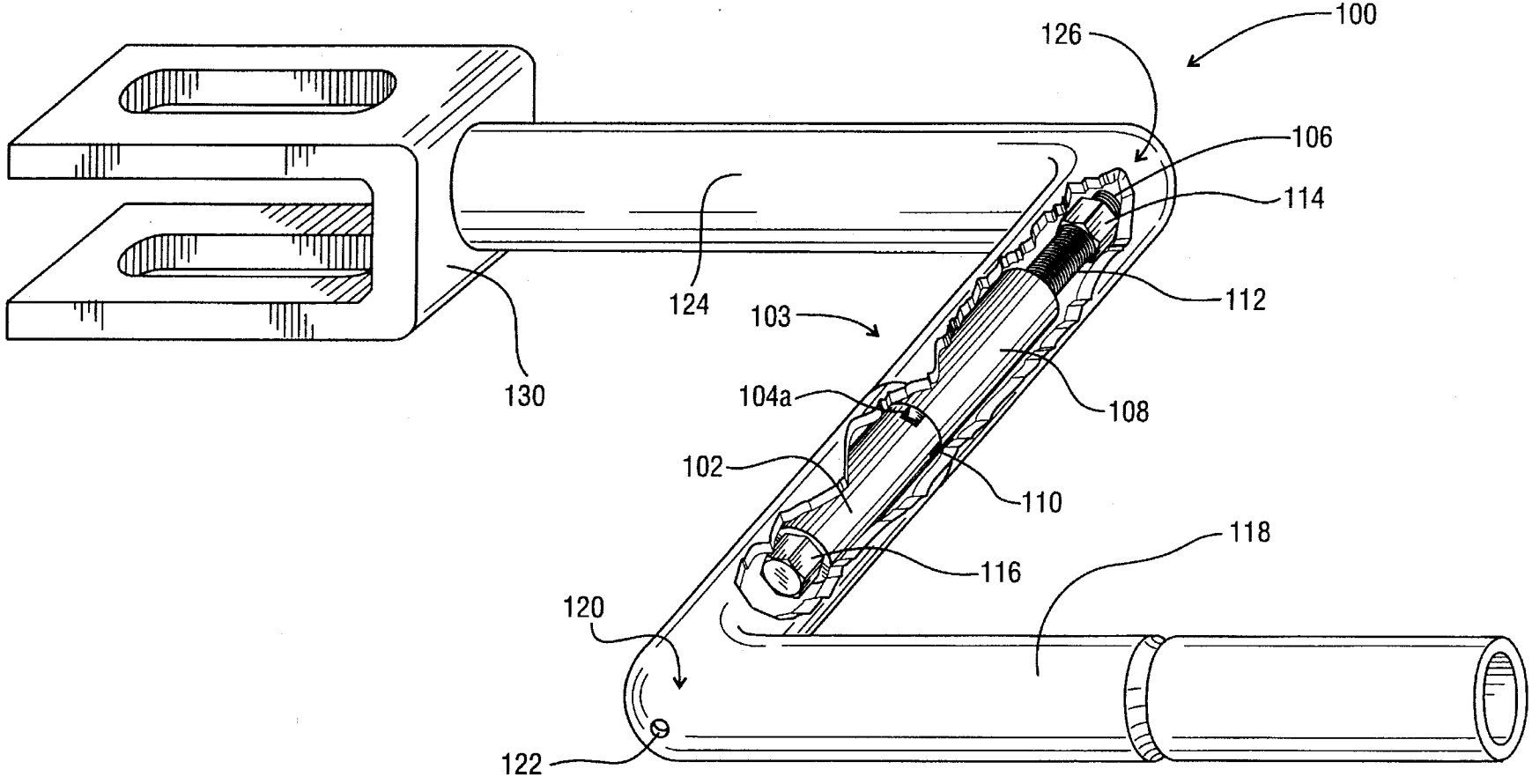
FIG. 1 is a cutaway view of an axially pivotable crank handle showing spring-tensioned cooperating axially pivotable members in a locked position oriented away from an attachment bracket, according to a preferred embodiment of the present invention.
Figure 2A:
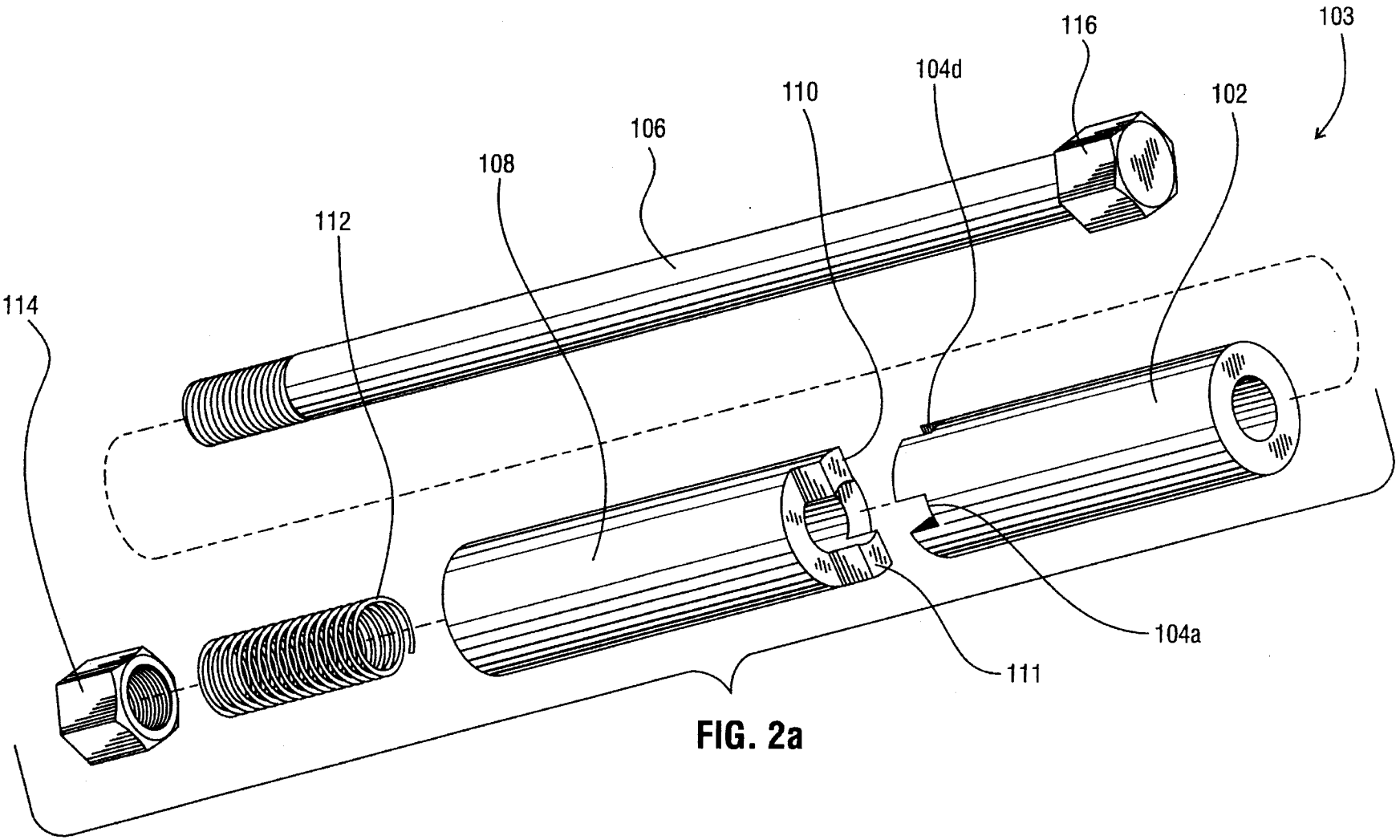
FIG. 2*a* is a top and side perspective view of the spring-tensioned cooperating axially pivotable members and associated axle of FIG. 1, according to a preferred embodiment of the present invention.
Figure 2B:
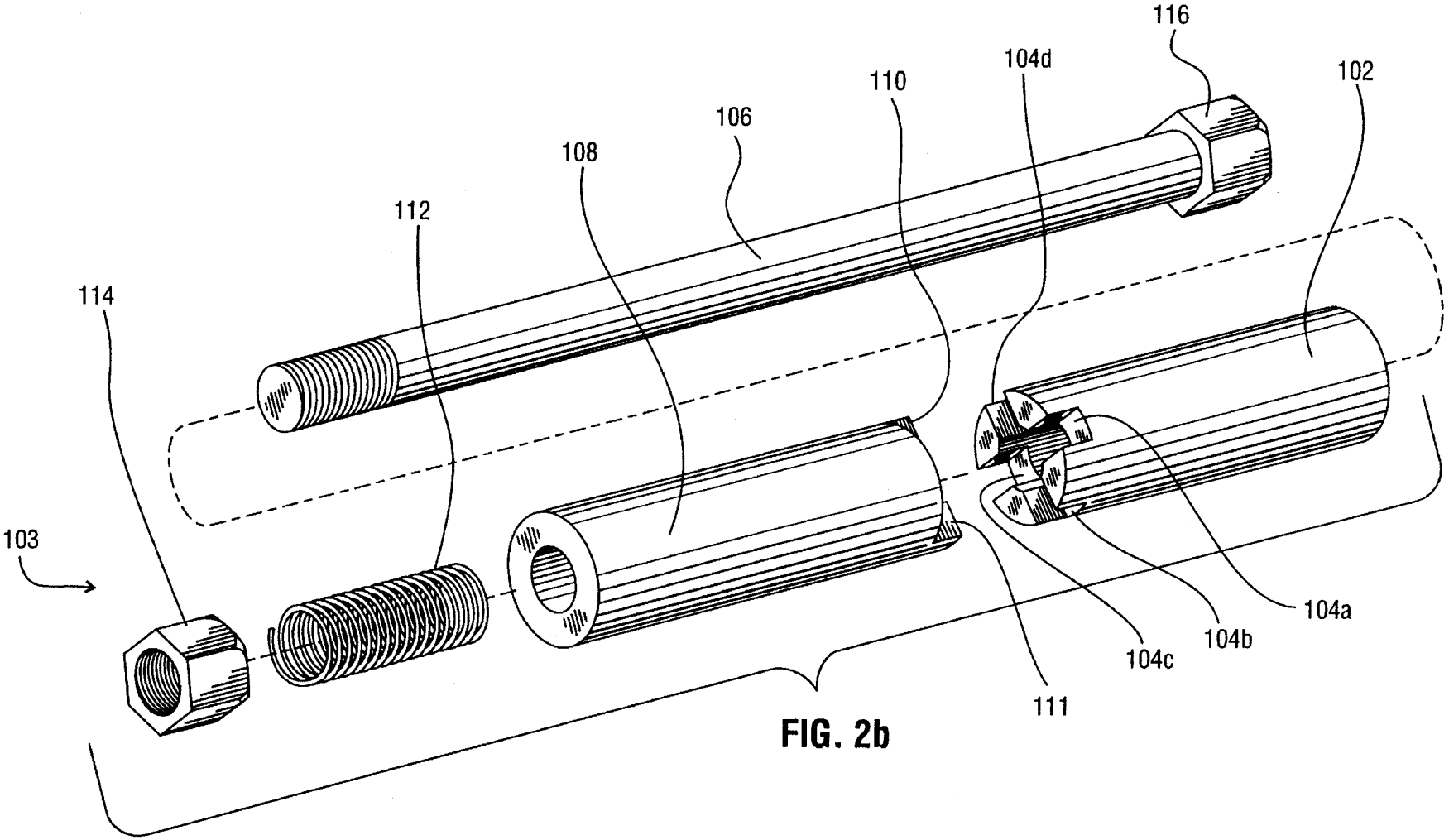
FIG. 2*b* is a bottom and side perspective view of the spring-tensioned cooperating axially pivotable members and associated axle of FIG. 1, according to a preferred embodiment of the present invention.

Referring now to FIGS. 1, 2*a* & 2*b*, a cutaway view of an axially pivotable crank handle 100 and an internal rotational mechanism 103 is shown in FIG. 1, according to the present invention. Perspective views of cooperating axially pivotable members and an associated axle 106 are shown in FIGS. 2*a* and 2*b*. A first cylindrical member 102 defining a plurality of female grooves 104*a*, 104*b*, 104*c*, 104*d* at an end of said first member 102 is slidable onto an axle 106, preferably an 8 inch threaded machine bolt, for instance. A second cylindrical member 108 having a plurality of male prongs 110 and 111 extending from an end of said second cylindrical member 108 is slidable onto the axle 106 such that the male prongs 110 and 111 engages opposing of said plurality of female grooves 104*a*, 104*b*, 104*c*, 104*d*, thereby to position said second cylindrical member 108 in a rotationally locked position about said axle 106 relative to said first cylindrical member 102. A spring 112 is slidable onto the axle 106 and preferably held onto the axle 106 by a threaded nut 114 which is threaded onto the axle 106. In this manner, the spring urges the second member 108 against the first member 102 which is pressed against a head 116 of the axle 106. A preferred embodiment affixes the first cylindrical member 102 to the axle 106 by welding the first cylindrical member 102 to the head 116. Although the preferred embodiment includes a protective casing covering each cylindrical member, other alternate embodiments are envisioned deleting such protective casings and in which the cylindrical members themselves form the angled bends. In such an alternate embodiment, however, the axle 106 would not remain rotating due to the head 116 being welded to the first cylindrical member 102. In such an embodiment, the head 116 is retained by the first cylindrical member 102 in a freely rotating manner.

In a preferred embodiment of the present invention, the first cylindrical member 102, the second cylindrical member 108, and the spring 112 are slid onto the axle 106 and affixed with the threaded nut 114 before a first protective casing 118 is affixed to the first cylindrical member 102, thereby to rotate with the first cylindrical member 102 about the axle 106. A preferred embodiment of the present invention welds the first protective casing 118 to the first cylindrical member 102. The first protective casing 118 encases the first cylindrical member and the head 116 of the axle 106, and extends lengthwise therefrom the first cylindrical member 102, in order to provide rotational leverage by lengthening the first cylindrical member. A preferred embodiment of the first protective casing 118 defines a first angled bend 120 therein. A preferred angle of the first angled bend is a right angle formed by the first protective casing. A preferred embodiment of the first protective casing 118 includes a first drain hole 122 positioned at the first angled bend 120 for draining liquid which has accumulated within the first protective casing 118.

A second protective casing 124 is affixed to the second cylindrical member 108, thereby to rotate with the second cylindrical member 108 about the axle 106. A preferred embodiment of the present invention welds the second protective casing 124 to the second cylindrical member 108. The second protective casing 124 encases the second cylindrical member 108 and the spring 112 and threaded nut 114 of the axle 106, and extends lengthwise therefrom the second cylindrical member 108, in order to provide rotational leverage by lengthening the second cylindrical member. A preferred embodiment of the second protective casing 124 defines a second angled bend 126 therein. A preferred angle of the second angled bend 126 is a right angle formed by the second protective casing. An attachment bracket 130 is affixed to said second protective casing 124 at an end opposing the end affixed to the second cylindrical member 108. The attachment bracket 130 receives a conventional rotational crank screw (not shown) of a conventional dolly stand post (not shown) on a conventional tractor trailer (not shown). A preferred embodiment of the second protective casing 124 includes a second drain hole 132 (see FIG. 8) positioned at the second angled bend 126 for draining liquid which has accumulated within the second protective casing 124.

A preferred embodiment of the present invention is manufactured of a metal material, such as steel or an alloy, which is of sufficient strength to withstand rotational force applied to the axially pivotable crank handle 100. The top and side perspective view of FIG. 2*a* illustrates the plurality of male prongs 110 and 111. The bottom and side perspective view of FIG. 2*b* illustrates the plurality of female grooves 104*a*, 104*b*, 104*c*, 104*d*.

Figure 3:
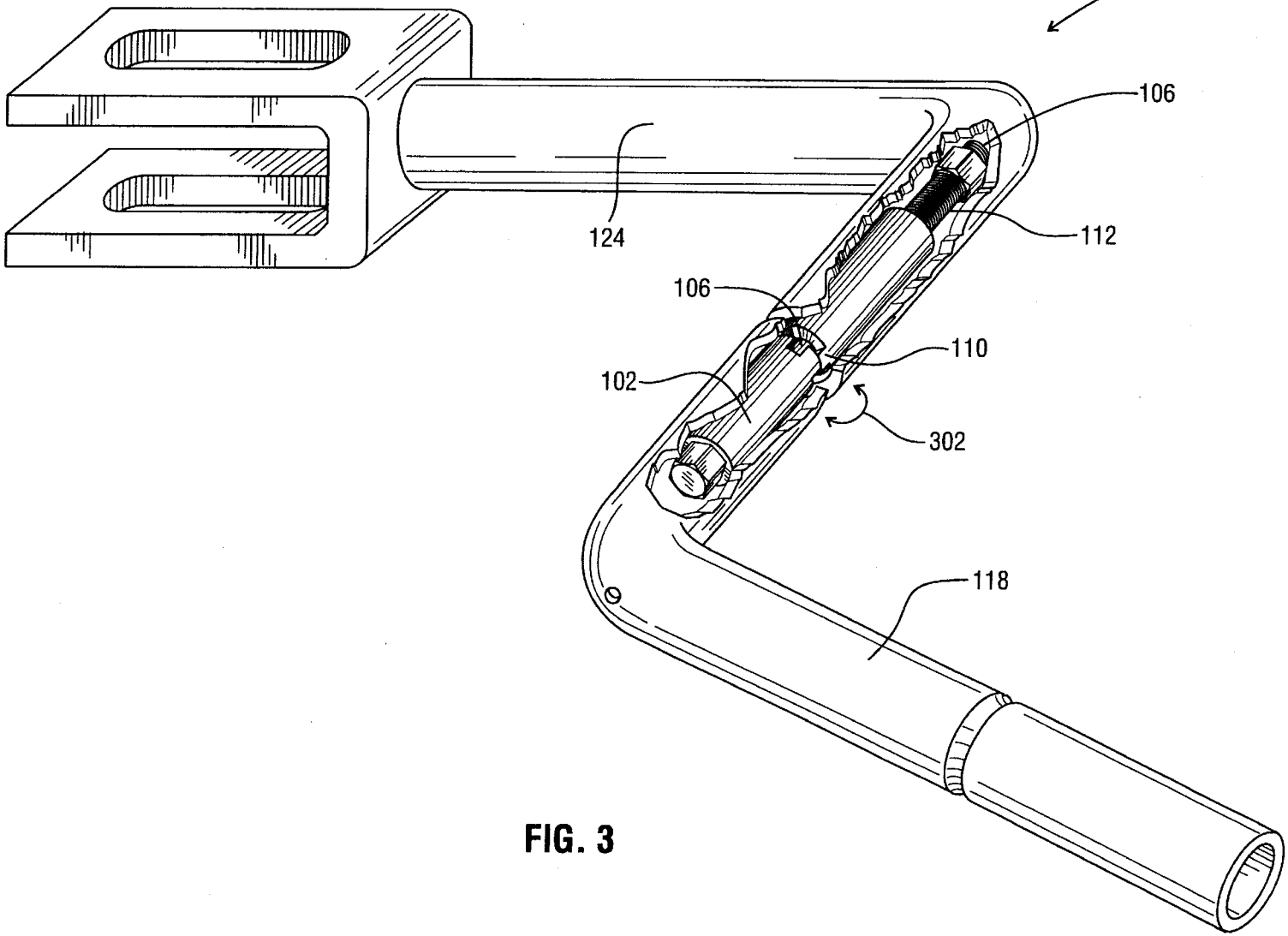
FIG. 3 is a cutaway view of the axially pivotable crank handle of FIG. 1 showing the spring tensioned cooperating axially pivotable members in a unlocked rotatable position, according to a preferred embodiment of the present invention.

Referring to FIG. 3, the axially pivotable crank handle 100 is shown in an unlocked position wherein the first cylindrical member 102 and the attached first protective casing 118 is separated from said second cylindrical member 108 and the attached second protective casing 124 along the axle 106 against the urging force of the spring 112. Note that the spring 112 is compressed in FIG. 3 compared to FIG. 1. The plurality of male prongs 110 and 111 rests atop the end of the first cylindrical member 102 which defines the plurality of female grooves 104*a* 104*b*, 104*c*, 104*d*. The first cylindrical member 102 and the attached first protective casing 118 is pivotally rotatable about said axle 106, in the direction shown by a bidirectional arrow 302, until the plurality of male prong 110 and 111 aligns with opposing of the plurality of female grooves 104*a*, 104*b*, 104*c*, 104*d*, thereby to snap into locked position within opposing of the plurality of female grooves 104*a*, 104*b*, 104*c*, 104*d*, according to the urging of the second cylindrical member 108 toward the first cylindrical member 102 by the spring 112.

Figure 4:
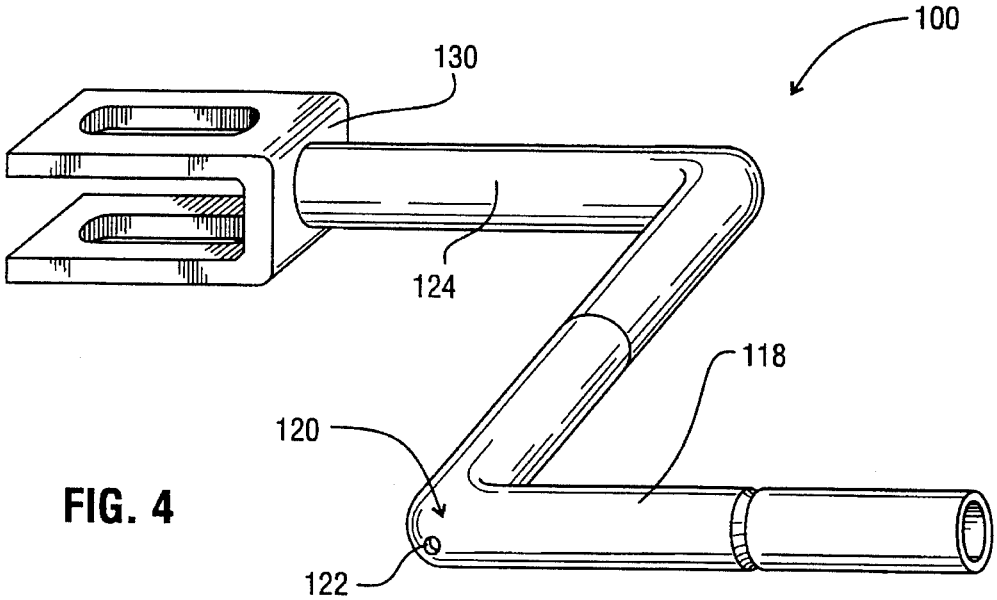
FIG. 4 is a perspective view of a axially pivotable crank handle oriented away from the attachment bracket, according to a preferred embodiment of the present invention.

FIGS. 4, 5, 6, and 7 show the axially pivotable crank handle 100 locked into various orientations. In FIG. 4, the first protective casing 118 with the first angled bend 120 is shown oriented to the right of the axle 106 (see FIG. 1). The orientation of FIG. 4 occupies lateral space to the right of the axle 106 (see FIG. 1) and permits maximum rotational torque to be applied to the attachment bracket 130.

Figure 5:
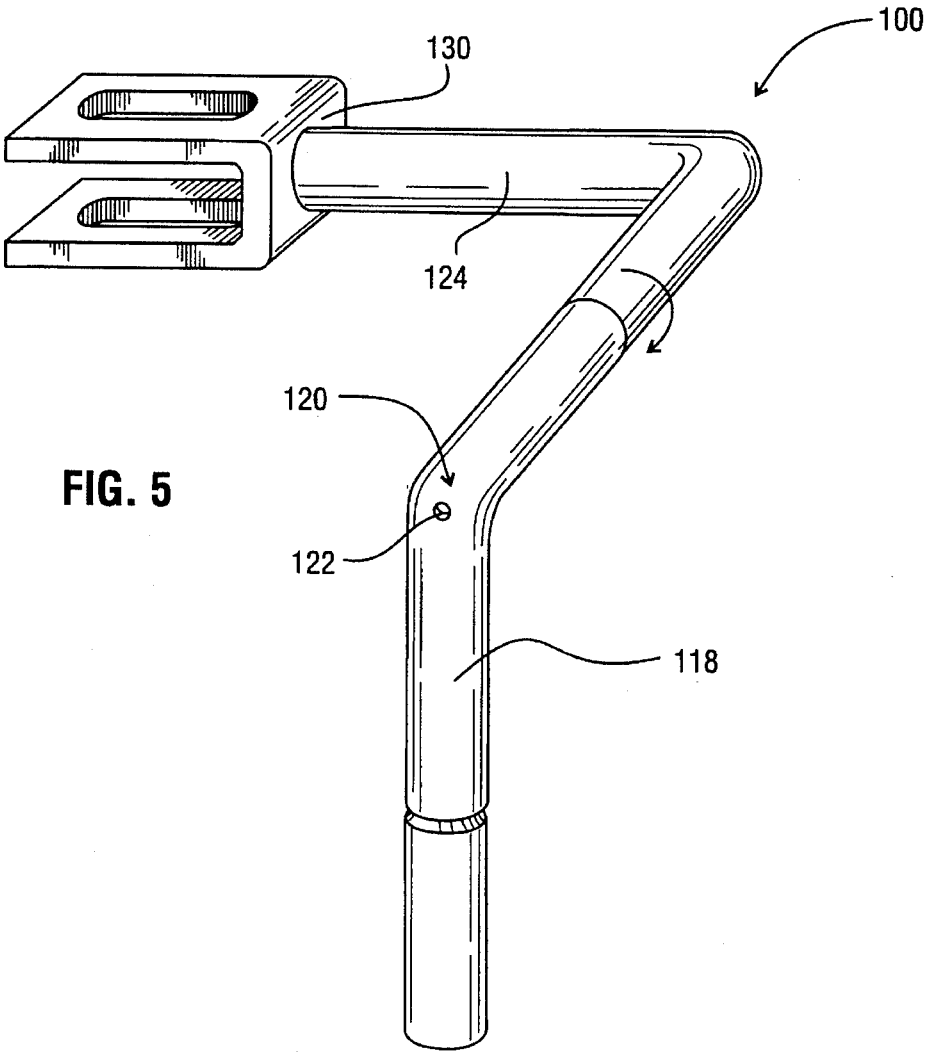
FIG. 5 is a perspective view of the axially pivotable crank handle of FIG. 1 oriented downwardly from the attachment bracket, according to a preferred embodiment of the present invention.

In FIG. 5, the first protective casing 118 with the first angled bend 120 is shown rotated and oriented 90 degrees to the left of the orientation shown in FIG. 4. The orientation of FIG. 5 occupies lateral space below the axle 106 (see FIG. 1) and permits less than maximum rotational torque to be applied to the attachment bracket 130.

Figure 6:
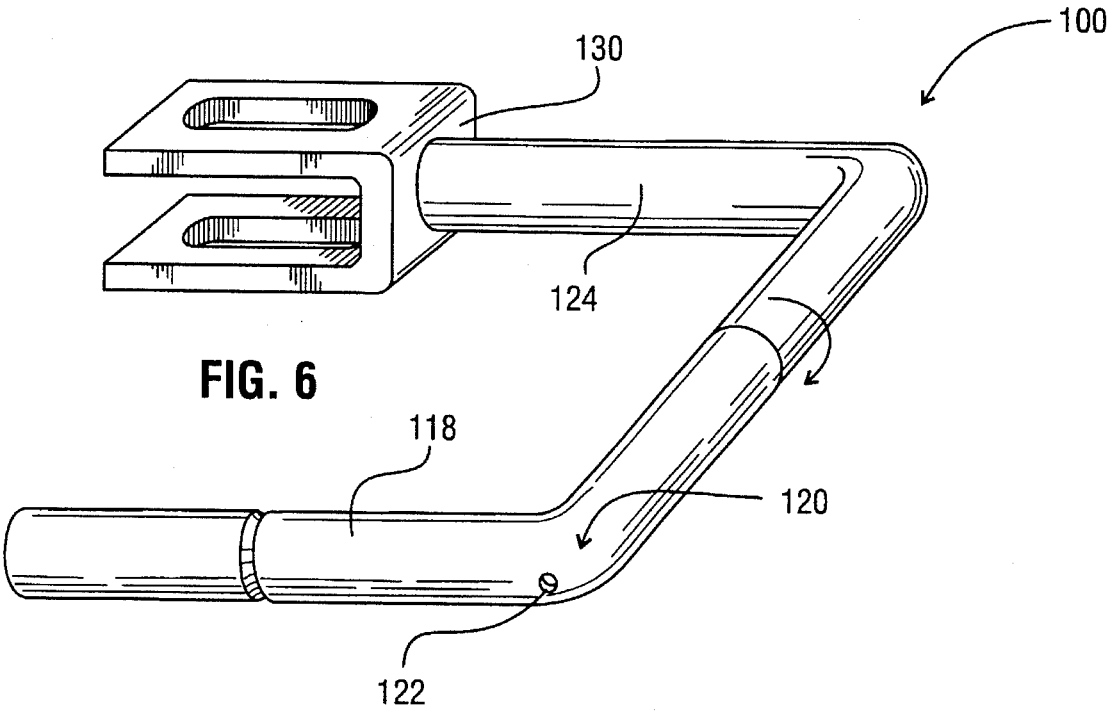
FIG. 6 is a perspective view of the axially pivotable crank handle of FIG. 1 oriented toward the attachment bracket, according to a preferred embodiment of the present invention.

In FIG. 6, the first protective casing 118 with the first angled bend 120 is shown rotated and oriented 90 degrees to the left of the orientation shown in FIG. 5. The orientation of FIG. 6 occupies lateral space to the left of the axle 106 (see FIG. 1) and permits less than maximum rotational torque to be applied to the attachment bracket 130.

Figure 7:
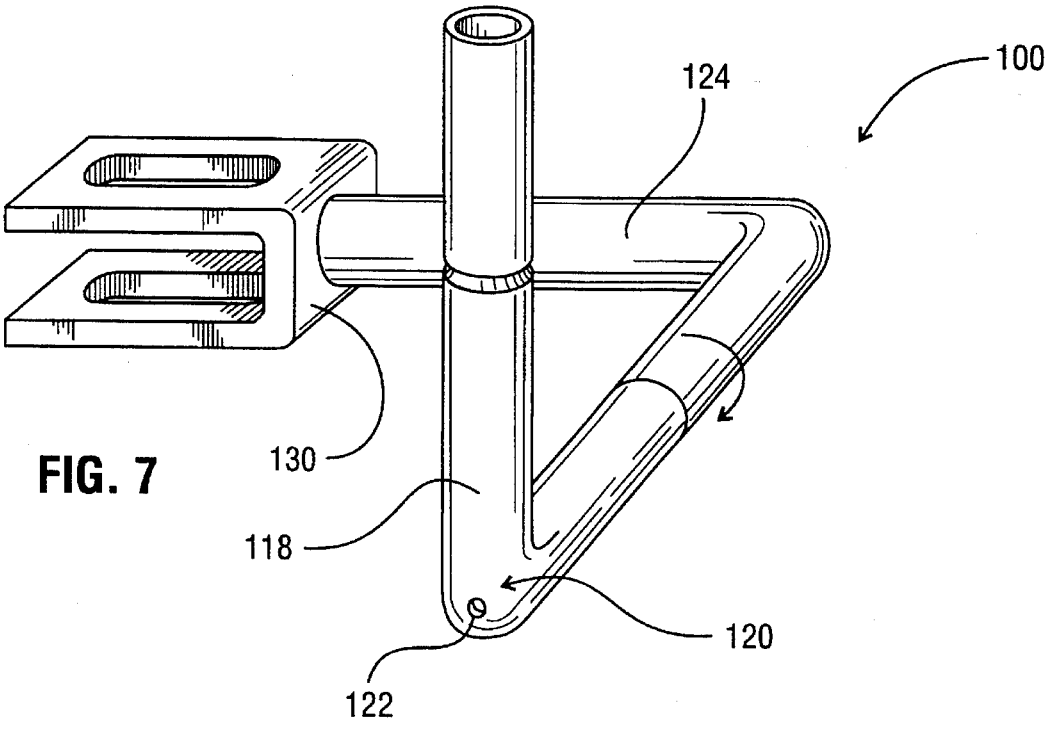
FIG. 7 is a perspective view of the axially pivotable crank handle of FIG. 1 oriented upwardly from the attachment bracket, according to a preferred embodiment of the present invention.

In FIG. 7, the first protective casing 118 with the first angled bend 120 is shown rotated and oriented 90 degrees above the orientation shown in FIG. 6. The orientation of FIG. 7 occupies lateral space to the left of the axle 106 (see FIG. 1) and permits less than maximum rotational torque to be applied to the attachment bracket 130.

The first protective casing 118 with the first angled bend 120 may also be rotated and oriented 90 degrees to the left of the orientation shown in FIG. 7, thereby to return to the orientation shown in FIG. 4.

Figure 8:
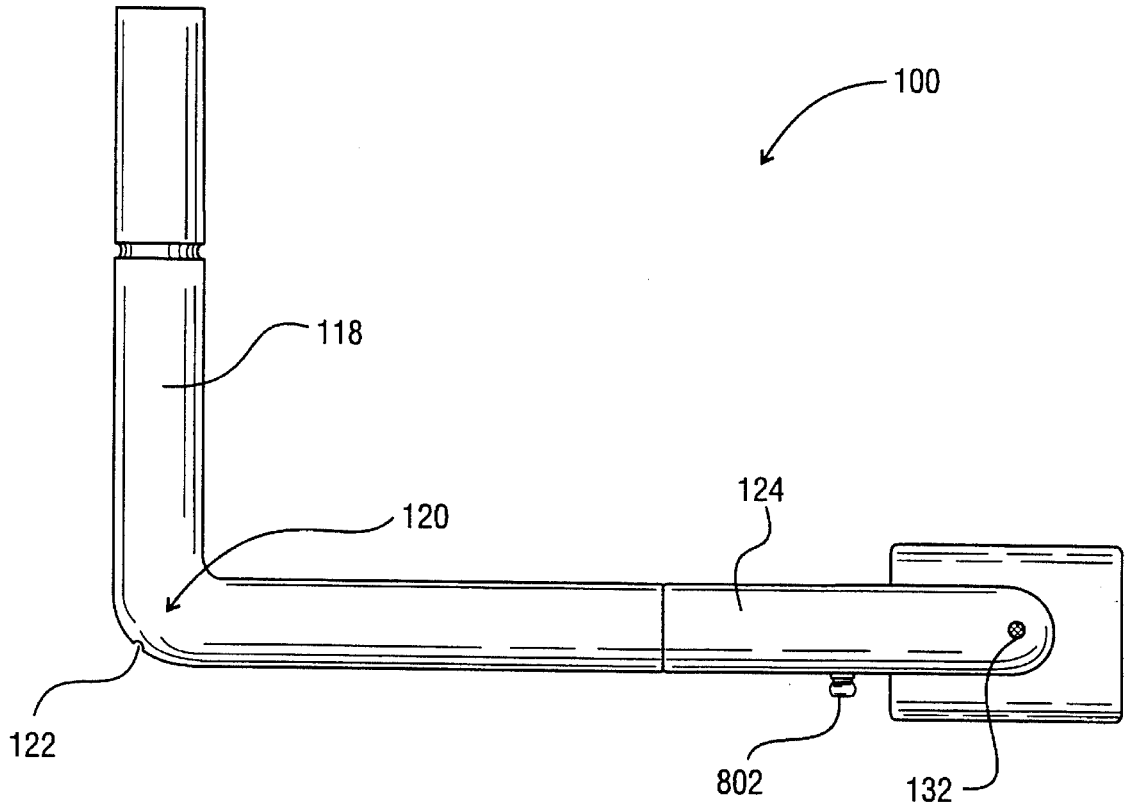
FIG. 8 is a bottom elevational view of the axially pivotable crank handle of FIG. 7, showing a grease zerk according to a preferred embodiment of the present invention.

FIG. 8 is a bottom elevational view of the axially pivotable crank handle 100 positioned in the orientation of FIG. 7 showing a grease jerk 802 according to a preferred embodiment of the present invention. The grease jerk 802 provides access through which the spring 112 encased by the second protective casing 124 may be lubricated. Furthermore, the spring 112 encased by the second protective casing 124 may also be lubricated through the first drain hole 122 and through the second drain hole 132.

2. Operation of the Preferred Embodiment

The axially pivotable crank handle 100 is attached to a rotatable crank (not shown) with the attachment bracket 130 in a manner which is known in the art. An operator (not shown) positions the first protective casing 118 in a preferred orientation relative to the second protective casing 124 by grasping the first protective casing 118 and pulling outwardly away from the second protective casing 124 and against the urging force of the spring 112, thereby to compress the spring 112 by sliding the first cylindrical member 102 and the axle 106 away from the second cylindrical member 108, in order to remove the plurality of male prongs 110 and 111 from the plurality of female grooves 104 far enough to permit the first cylindrical member 102 to rotate about the axle 106, unobstructed by the second cylindrical member 108.

From this unobstructed position, the operator rotates the first cylindrical member 102 and the associated first protective casing 118 about the axle 106 to a preferred position, relative to the second protective casing 124. Relaxing the grasp in order to permit the spring 112 to urge the first cylindrical member 102 and the axle 106 toward the second cylindrical member 108 will position the plurality of male prongs 110 and 111 atop the end of the second cylindrical member 108 which defines the plurality of female grooves 104*a*, 104*b*, 104*c*, 104*d*.

Rotating the first protective casing 118 about the axle 106 aligns the plurality of male prongs 110 and 111 with cooperating female grooves, thereby permitting the first cylindrical member 102 to lockingly engage the second cylindrical member 108. The axially pivotable crank handle 100 is adjustable to a plurality of orientations in the manner described in order to exchange leverage for unobstructed positioning, as required according to the proximity of an obstruction to the present invention.

When held in a locked orientation by the spring 112, the axially pivotable crank handle 100 is used to rotate the conventional dolly stand post on the conventional tractor tailor in a manner well-known in the art. Lubrication may be introduced within the first and second protective casings 118 and 124 through the grease jerk 802 and the first drain hole 122 and the second drain hole 132.

Thus, there has been shown and described a axially pivotable crank handle for adjusting a dolly stand post on a conventional tractor tailor which fulfills all the objects and advantages sought therefore. Many changes, modifications, variations and other uses and applications of the subject invention will, however, become apparent to those skilled in the art after considering this specification and the accompanying drawings which disclose a preferred embodiment thereof. All such changes, modifications, variations and other uses and applications which do not depart from the spirit and scope of the invention are deemed to be covered by the invention which is limited only by the claims which follow.

What is claimed is:

1. A crank handle for adjusting a rotational crank of a dolly stand post on a tractor trailer, wherein the crank handle comprises:

a first cylindrical member having a male prong protruding from a first cylindrical member end;

a second cylindrical member having a second cylindrical member end which defines a plurality of female grooves for receiving and cooperating with said male prong;

a spring;

an axle axially disposed within said first cylindrical member, said second cylindrical member, and said spring, such that said spring urges said first cylindrical member toward said second cylindrical member thereby to engage into an interlocked position said male prong with one of said plurality of female grooves, by rotating said first cylindrical member about said axle relative to said second cylindrical member;

a first member casing attached to said first cylindrical member, wherein said first member casing defines a first angled elbow bend;

a second member casing affixed to said second cylindrical member, wherein said second member casing defines a second angled elbow bend;

an attachment bracket affixed to said first member casing for attaching said crank handle to said rotational crank.

2. The crank handle according to claim 1, wherein said first and second angled elbow bend forms a right angle.

3. The crank handle according to claim 2, wherein said first member casing further comprises:

lubrication means through which said axle is lubricated.

4. The crank handle according to claim 2, wherein said crank handle is manufactured of a metal material which has sufficient strength to withstand rotational force applied thereto.

5. The crank handle according to claim 4, wherein said metal material is steel.

6. The crank handle according to claim 3, wherein said lubrication means is a grease zerk.

* * * * *